US006318269B1

(12) United States Patent
Hoffmann et al.

(10) Patent No.: US 6,318,269 B1
(45) Date of Patent: Nov. 20, 2001

(54) AIR CURRENT OPERATED PROJECTILE FUZE

(75) Inventors: Wolfgang Hoffmann, Velbert; Karlheinz Roosmann, Fassberg-Müden, both of (DE)

(73) Assignee: Rheinmetall W & M GmbH, Unterlüss (DE)

( * ) Notice: Subject to any disclaimer, the term of this patent is extended or adjusted under 35 U.S.C. 154(b) by 0 days.

(21) Appl. No.: 09/551,196

(22) Filed: Apr. 17, 2000

(30) Foreign Application Priority Data

Apr. 15, 1999 (DE) ..... 199 17 121

(51) Int. Cl.[7] ..... F42C 15/32
(52) U.S. Cl. ..... 102/223
(58) Field of Search ..... 102/229, 226, 102/260, 223

(56) References Cited

U.S. PATENT DOCUMENTS

| | | | | |
|---|---|---|---|---|
| H136 | * | 10/1986 | Field | 102/487 |
| 3,913,483 | * | 10/1975 | Wolterman | 102/476 |
| 3,926,122 | * | 12/1975 | Wolterman | 102/226 |
| 3,956,992 | * | 5/1976 | Tari | 102/244 |
| 4,455,940 | * | 6/1984 | Furuike | 102/228 |
| 4,662,278 | * | 5/1987 | Lillios | 102/223 |
| 4,762,066 | * | 8/1988 | Rudenauer et al. | 102/226 |
| 4,998,476 | * | 3/1991 | Rudenauer et al. | 102/226 |
| 5,048,419 | * | 9/1991 | Skowasch | 102/226 |
| 5,142,079 | * | 8/1992 | Chiba et al. | 556/183 |
| 5,206,457 | | 4/1993 | Pascal et al. . | |
| 5,387,257 | * | 2/1995 | Tari et al. | 102/226 |
| 5,440,992 | * | 8/1995 | Chemiere et al. | 102/246 |
| 5,549,047 | * | 8/1996 | Borgni | 102/256 |

FOREIGN PATENT DOCUMENTS 3538787 5/1987 (DE) .

* cited by examiner

*Primary Examiner*—Charles T. Jordan
*Assistant Examiner*—Jordan M Lofdahl
(74) *Attorney, Agent, or Firm*—Venable; Gabor J. Kelemen

(57) ABSTRACT

A projectile includes a fuze assembly which has a firing pin carrier supported for motion parallel to a longitudinal axis of the projectile; a firing pin secured to the firing pin carrier; a slide supported for motion transversely to the projectile longitudinal axis and having a safety position and a firing position; and a detonator mounted on the slide. The detonator is out of alignment with the firing pin in the safety position of the slide and is in alignment with the firing pin in the firing position of the slide. A holding shell is positioned in the projectile and is exposed to a force of an air current during projectile flight for causing the holding shell to fly off the projectile. A force-transmitting component connects the holding shell with the slide for displacing the slide from the safety position into the firing position upon movement of the holding shell away from the projectile.

11 Claims, 4 Drawing Sheets

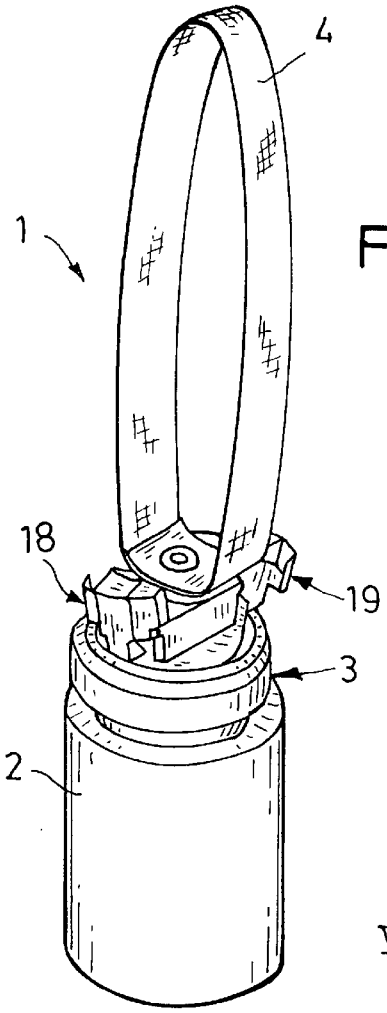
FIG.4
FIG.5
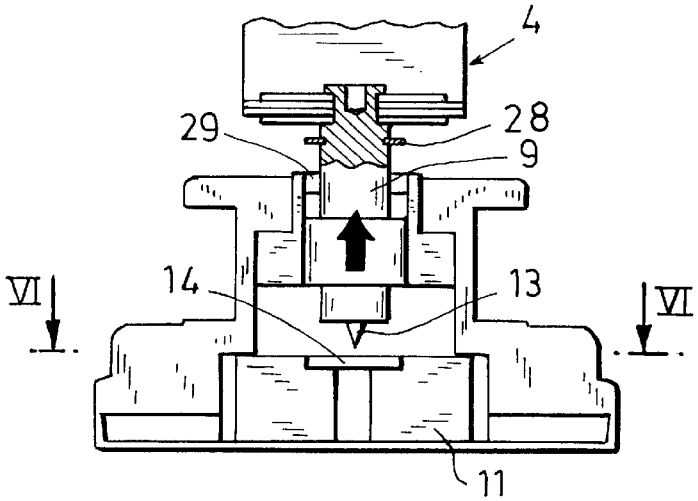
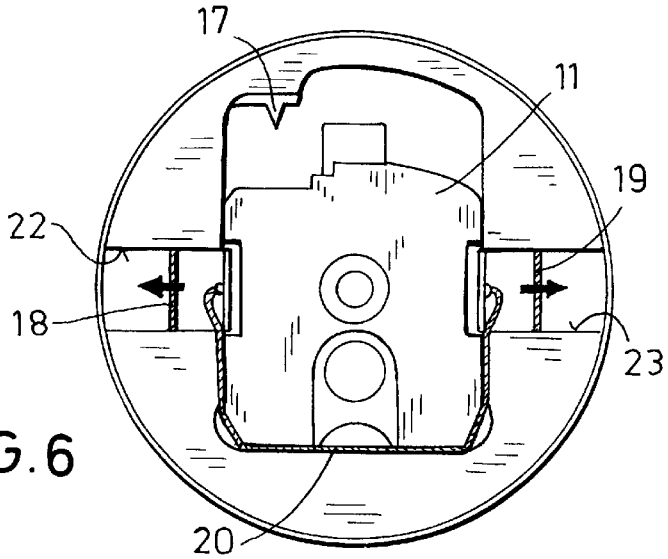
FIG.6

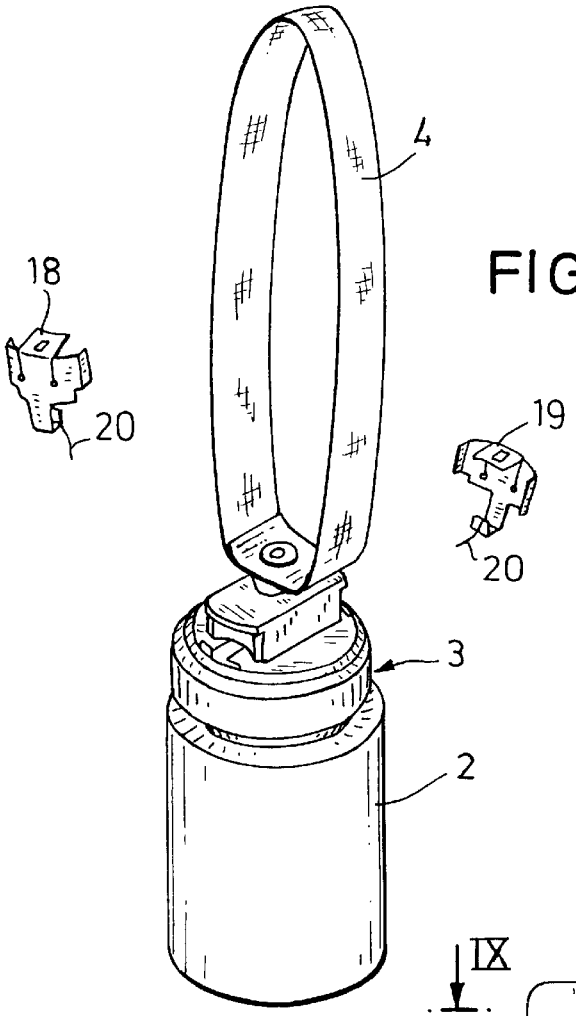
FIG.7
FIG.8
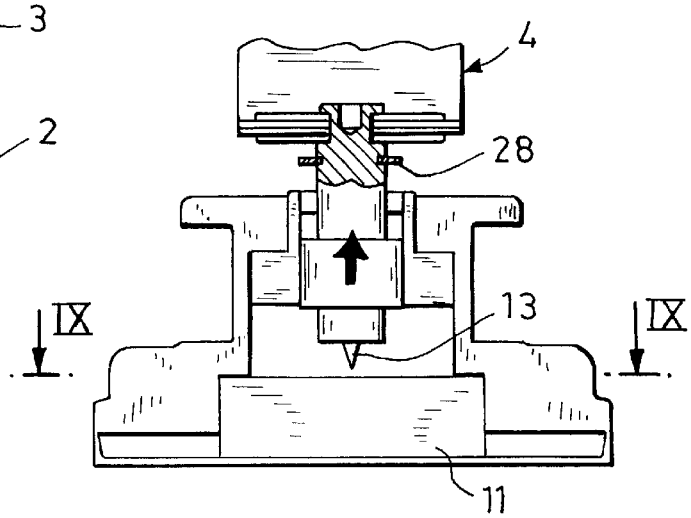
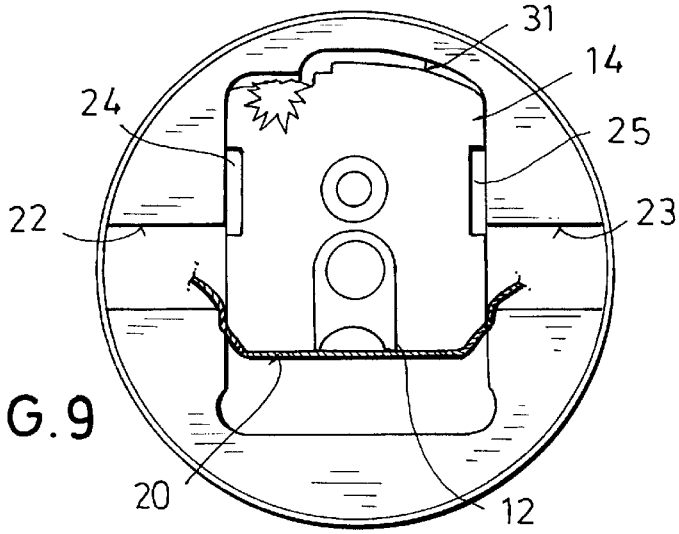
FIG.9

FIG.10
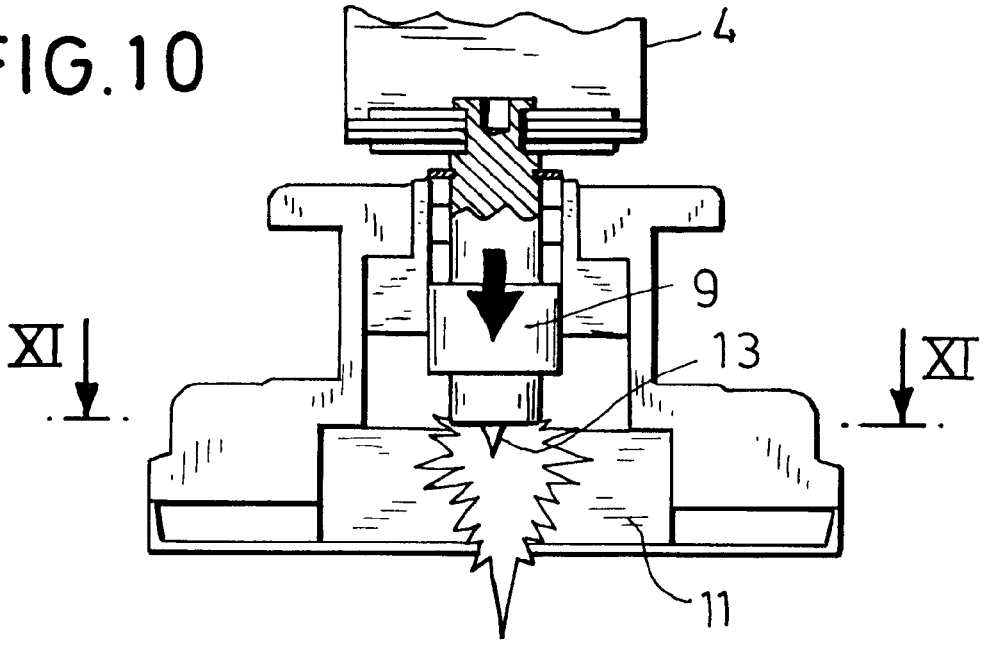
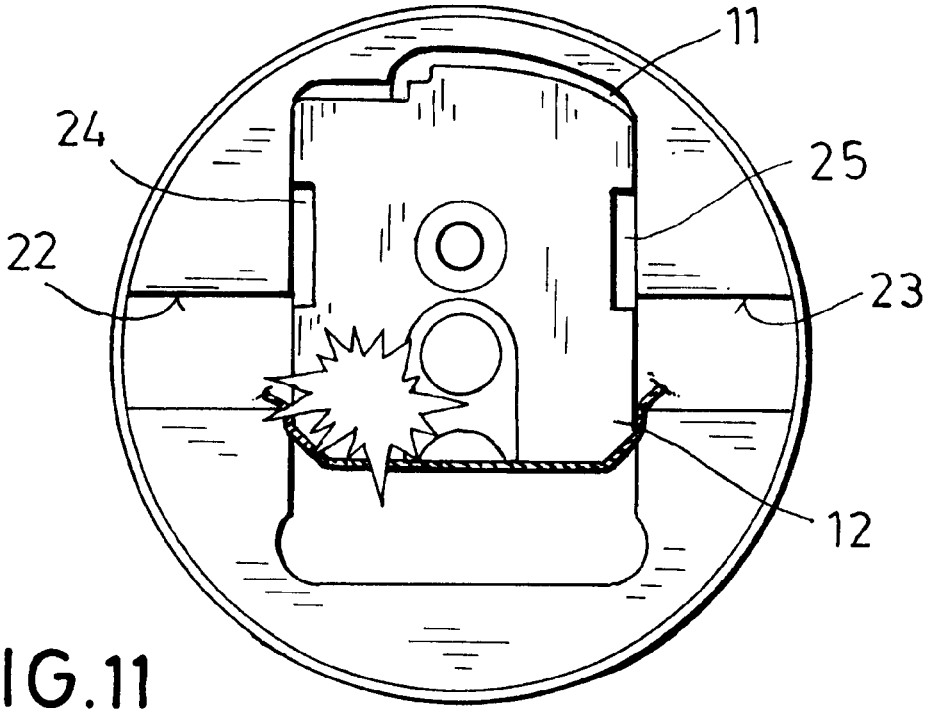
FIG.11

AIR CURRENT OPERATED PROJECTILE FUZE

CROSS REFERENCE TO RELATED APPLICATION

This application claims the priority of German Application No. 199 17 121.1 filed Apr. 15, 1999, which is incorporated herein by reference.

BACKGROUND OF THE INVENTION

This invention relates to a submunition projectile having a deployable stabilizing band mounted on a rearward portion of the projectile.

A submunition projectile (bomblet) of the above-outlined type is described, for example, in U.S. Pat. No. 5,048,419. The projectile described therein includes a fuze having an axially shiftable firing pin carrier and a slide which has a detonator charge and which is shiftable transversely to the projectile axis from a safety position into a firing position. A first firing pin is mounted on the firing pin carrier on its side oriented towards the slide. In the safety state of the projectile the first firing pin projects into a recess and is coupled with a projectile stabilizing band on its side oriented away from the slide. Further, as a backup detonator, the slide carries a pyrotechnic delay charge with a primer for the self-destruction of the bomblet. The primer may be ignited by a second firing pin affixed laterally in the fuze housing.

To ensure that the slide, together with the detonator charge is shifted into the firing position in the known bomblets, the bomblet, after being ejected from the carrier projectile, must rotate about its longitudinal axis so that the centrifugal forces affecting the stabilizing band and the slide result in an unscrewing of the first firing pin from the recess of the slide and cause a displacement of the slide from the safety position into the firing position in which the first firing pin is in alignment with the detonator charge.

It is, among others, a disadvantage of submunition projectiles of the above-outlined type that they cannot be fired from weapon systems in which the submunition projectiles, after their ejection over the target area, do not rotate with a sufficient rpm or do not rotate at all. This occurs, for example, when the bomblets are delivered into the target area by wing-stabilized carrier projectiles, such as rockets.

While it is feasible in non-rotating submunition projectiles to cause a shift of the detonator carrier by means of an armed spring, such a solution, however, is, as a rule, not admissible for safety reasons because in case of a break-off of the first firing pin, the detonator carrier would automatically shift the detonator carrier into its firing position and thus the self-destructing (backup) charge would be ignited.

SUMMARY OF THE INVENTION

It is an object of the invention to provide an improved projectile of the above-outlined type wherein the slide which carries the detonator charge is shifted from its safety position into its firing position without it being necessary that the projectile rotate after it is ejected over the target area.

This object and others to become apparent as the specification progresses, are accomplished by the invention, according to which, briefly stated, the projectile includes a fuze assembly which has a firing pin carrier supported for motion parallel to a longitudinal axis of the projectile; a firing pin secured to the firing pin carrier; a slide supported for motion transversely to the projectile longitudinal axis and having a safety position and a firing position; and a detonator mounted on the slide. The detonator is out of alignment with the firing pin in the safety position of the slide and is in alignment with the firing pin in the firing position of the slide. A holding shell is positioned in the projectile and is exposed to a force of an air current during projectile flight for causing the holding shell to fly off the projectile. A force-transmitting component connects the holding shell with the slide for displacing the slide from the safety position into the firing position upon movement of the holding shell away from the projectile.

Thus, according to the invention, laterally of the slide advantageously two shell-shaped holding parts are arranged which may be ejected by forces derived from the air current. Each holding part is connected by a pull cord with the slide in such a manner that upon ejection of the holding parts the slide, by virtue of the removal of the holding parts, is released from its safety position and is shifted into its firing position.

According to a further feature of the invention, the firing pin carrier is connected to the stabilizing band and, in the safety position of the slide, the firing pin projects into a hole in the slide to thus prevent the slide from shifting out of the safety position. The slide is displaced by the pull cord into the firing position, as soon as the firing pin carrier is displaced axially rearward by the deploying stabilizing band and thus the firing pin is pulled out of the hole in the slide.

Advantageously, the two holding parts (holding shells) and the slide are connected with the same pull cord which is trained about the slide.

For preventing the holding parts from adversely affecting the flying behavior of the bomblet, the pull cord is designed to rupture after the slide has been shifted into its firing position.

To ensure that the firing pin may be pulled out of the recess of the slide only when a defined pulling force is reached and thus releases the slide, according to a further feature of the invention on the firing pin carrier an annular spring disk is secured which frictionally engages the inner wall of a recess of the fuze housing.

BRIEF DESCRIPTION OF THE DRAWINGS

FIG. 4 is a perspective view of a preferred embodiment depicted in a first operational position during deployment of the stabilizing band.

FIG. 5 is an axial sectional view of the rearward terminal region of the bomblet in the first operational position.

FIG. 6 is a sectional view taken along line VI—VI of FIG. 5.

FIG. 7 is a perspective view of the preferred embodiment depicted in a second operational position during deployment of the stabilizing band.

FIG. 8 is an axial sectional view of the rearward terminal region of the bomblet in the second operational position.

FIG. 9 is a sectional view taken along line IX—IX of FIG. 8.

FIG. 10 is an axial sectional view of the rearward terminal region of the bomblet in a third (target-hitting) operational position.

FIG. 11 is a sectional view taken along line XI—XI of FIG. 10.

DESCRIPTION OF THE PREFERRED EMBODIMENT

Figure 1:
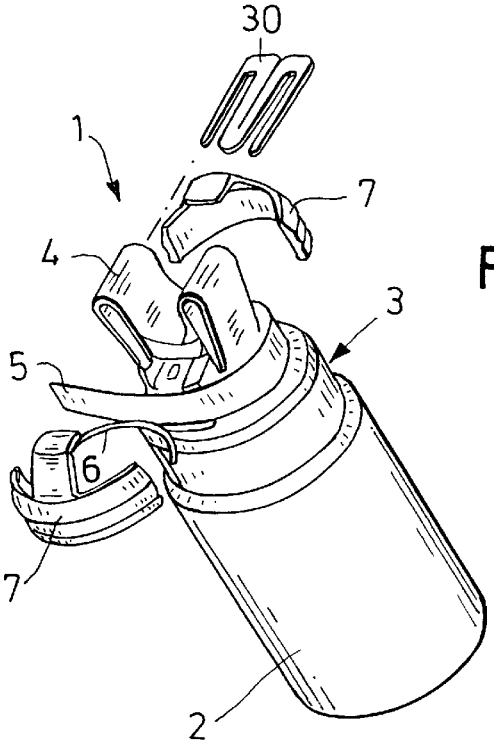
FIG. 1 is a perspective exploded view of a bomblet incorporating the invention.

FIG. 1 illustrates a bomblet 1 depicted in its condition shortly after being ejected over a target area from, for example, a non-illustrated bomblet carrier rocket. The bomblet 1 includes a projectile body 2 which accommodates, for example, a shaped charge (not shown), a fuze 3 for igniting the shaped charge and a folded stabilizing band 4 mounted in the rear portion of the projectile body 2. The stabilizing band 4 is secured by a wound ribbon 5 held together by a two-part protecting cap 7 surrounded by a resilient securing ring 6.

Figure 2:
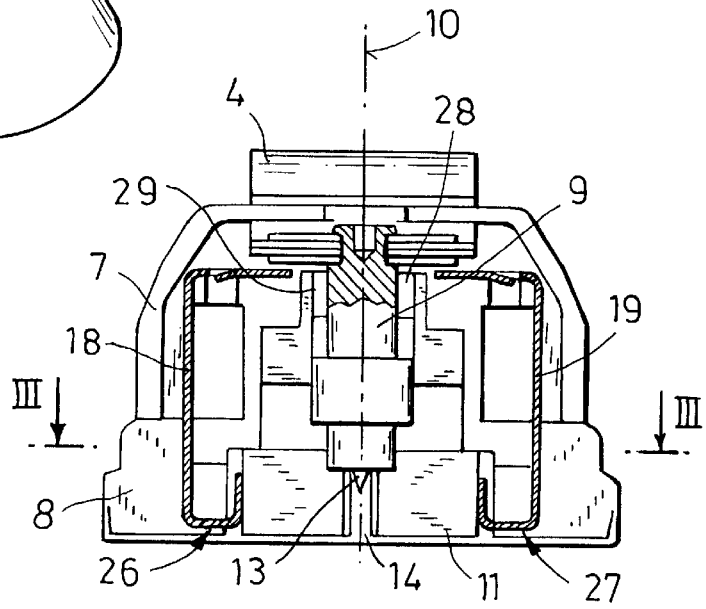
FIG. 2 is an axial sectional view of the rearward terminal region of the bomblet shown in FIG. 1.
Figure 3:
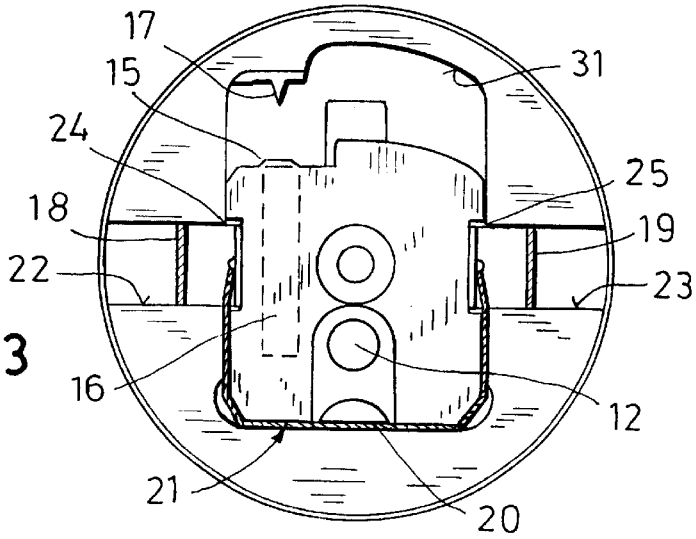
FIG. 3 is a sectional view taken along line III—III of FIG. 2.

As may be observed in FIGS. 2 and 3, the fuze 3 includes a fuze housing 8 in which an axially displaceable firing pin carrier 9 and a slide 11 which carries a detonator charge 12 and which may be shifted transversely to the longitudinal projectile axis 10 from a safety position into an igniting position. On that side of the firing pin carrier 9 which is oriented towards the slide 11 a first firing pin 13 is mounted which, when the bomblet is in its safety state, is out of alignment with the detonator charge 12 and projects into a hole 14 of the slide 11. A stabilizing band 4 is mounted on that side of the firing pin carrier 9 which is oriented away from the slide 11.

The slide 11 carries a pyrotechnic delay charge 16 having a primer 15 which may be ignited by a second firing pin 17 stationarily supported in the fuze housing 8 for initiating a self-destruction of the bomblet 1 in case the shaped charge has not been activated by the first firing pin 13, for example, because of a soft impacting of the bomblet in the target area.

The slide 11 may be locked in its firing position by a spring tongue (not shown for clarity) which is arranged in the fuze housing 8 and which engages a projection of the slide 11 when the latter is in its firing position.

According to the invention, laterally of the slide 11 two face-to-face oriented shell-shaped holding parts (holding shells) 18, 19 are arranged which are configured such that they are ejected by the force of the air current as the projectile falls. The two holding parts 18, 19 are connected to one another by a pull cord 20 which is trained about that side (rearward side) 21 of the slide 11 which is oriented away from the second firing pin 17.

The fuze housing 8 has lateral guides 22, 23 which cooperate with respective grooves 24, 25 of the slide 11. The end regions 26, 27 of the holding parts 18, 19 oriented towards the slide 11 are of U-shaped configuration and engage the guides 22, 23 of the fuze housing 8 and the lateral walls of the grooves 24, 25 of the slide 11.

The firing pin carrier 9 is secured by an annular spring disk 28 from sliding out axially rearward. The spring disk 28 which is mounted on the firing pin carrier 9 is in frictional engagement with the inner wall of a respective recess 29 of the fuze housing 8.

In the description which follows, the operation of the above-described structure will be set forth.

After ejection from a carrier projectile the individual bomblets 1 are separated. The stabilizing band 4 of the respective bomblet 1 is pulled out of its folded state by the force of the air current and is deployed. During this occurrence, as shown in FIG. 1, the plastic clamp 30, the spring ring 6 and the protective cap 7 snap off the fuze housing 8 and release the winding band 5 which unwinds and is thereafter ejected.

As shown in FIG. 4, during the deployment of the stabilizing band 4, the latter, against the pressure of the spring disk 28, pulls the firing pin holder 9 axially rearward and thus pulls the first firing pin 13 from the hole 14 of the slide 11. Subsequently, the holding parts 18, 19 are, by the air current, laterally shifted along the guides 22, 23 of the fuze housing 8 and, with the intermediary of the pull cord 20, displace the slide 11 radially from its safety position until the slide 11 abuts against the lateral wall 31 of the fuze housing 8 which corresponds to the firing position of the slide 11 as shown in FIG. 9. The non-illustrated spring tongue immobilizes the slide 11 in the firing position. Upon the arrival of the slide 11 in the firing position the detonator charge 12 of the bomblet 1 is situated in axial alignment with the first firing pin 13 and the second firing pin 17 has activated the primer 15 of the delay charge 16.

The holding parts 18 and 19 pulled outwardly in opposite directions by the air current eventually rupture the pull cord 20, whereupon the holding parts 18 and 19 drop off laterally as shown in FIGS. 7 and 9.

During a subsequent hard impact of the projectile the first firing pin 13 strikes the detonator charge 12 which ignites the shaped charge via a non-illustrated booster charge as shown in FIGS. 10 and 11.

In case the detonator charge 12 is not activated by the first firing pin 13 within a predetermined period (for example, because the bomblet 1 impacted on a very soft substance), the shaped charge is ignited by the ignition delay charge 16.

It is to be understood that the invention is not limited to the embodiment described above. Thus, for example, for increasing the resistance to pulling out the firing pin carrier 9, instead of a spring disk 28 a ball safety may be used or between the firing pin carrier 9 and the fuze housing 8 spring pins may be arranged.

Further, the pull cord 20 may be, in the alternative, guided through a bore hole of the slide 11. Or, two separate pull cords may be provided in which case with each holding part 18, 19 a separate pull cord is associated.

It will be understood that the above description of the present invention is susceptible to various modifications, changes and adaptations, and the same are intended to be comprehended within the meaning and range of equivalents of the appended claims.

What is claimed is:

1. A projectile comprising a fuze assembly including (a) a firing pin carrier supported for motion parallel to a longitudinal axis of said projectile;

(b) a firing pin secured to said firing pin carrier;

(c) a slide supported for motion transversely to said longitudinal axis; said slide having a safety position and a firing position;

(d) a detonator mounted on said slide; said detonator being out of alignment with said firing pin in said safety position of said slide and being in alignment with said firing pin in said firing position of said slide;

(e) a holding shell positioned in the projectile and being exposed to a force of an air current during projectile flight for causing said holding shell to be displaced relative to said projectile; and (f) force-transmitting means for connecting said holding shell with said slide for displacing said slide from said safety position to said firing position upon movement of said holding shell by the air current relative to said projectile.

2. The projectile as defined in claim 1, wherein said force-transmitting means is a pull cord.

3. The projectile as defined in claim 2, wherein said pull cord has a strength designed to rupture after said slide is displaced by said cord into said firing position.

4. The projectile as defined in claim 1, further comprising (g) a delay charge mounted on said slide; and (h) an additional firing pin held stationarily in alignment with said delay charge for striking and igniting said delay charge upon movement of said slide from said safety position into said firing position.

5. The projectile as defined in claim 1, wherein said holding shell is a first holding shell; further comprising a second holding shell; said first and second holding shells being disposed laterally adjacent said slide and said force-transmitting means being connected to said first and second holding shells.

6. The projectile as defined in claim 5, wherein said force-transmitting means comprises a pull cord having a first end attached to said first holding shell and a second end attached to said second holding shell; said pull cord having a portion between said first and second ends exerting a force on said slide upon movement of said first and second holding shells from said projectile.

7. The projectile as defined in claim 6, wherein said pull cord is trained about a portion of said slide in said safety position thereof.

8. The projectile as defined in claim 1, further comprising (g) a stabilizing band mounted on a rear portion of said projectile and having a folded state and a deployed state;

(h) a hole provided in said slide and being in alignment with said firing pin in said safety position of said slide; said firing pin projecting into said hole in said safety position of said slide; and (i) connecting means for coupling said stabilizing band to said firing pin carrier for axially rearward displacing said firing pin carrier by said stabilizing band upon movement thereof from said folded state into said deployed state.

9. The projectile as defined in claim 1, further comprising a fuze housing provided with a lateral guide; further wherein said slide is provided with a lateral groove, and said holding shell is in engagement with said groove and said lateral guide.

10. The projectile as defined in claim 1, wherein said holding shell has a U-shaped terminal portion oriented toward said slide.

11. The projectile as defined in claim 1, further comprising a fuze housing having a wall portion defining an opening surrounding said firing pin carrier; and a spring disk attached to said firing pin carrier and frictionally engaging said wall portion for preventing said firing pin carrier from sliding out of said housing in a direction away from said slide.

* * * * *